US010463200B2

(12) United States Patent
Patterson et al.

(10) Patent No.: US 10,463,200 B2
(45) Date of Patent: Nov. 5, 2019

(54) ACCESSORY RAIL SYSTEM FOR BATH OR SHOWER WALLS

(71) Applicant: AS IP HOLDCO, LLC, Piscataway, NJ (US)

(72) Inventors: Charles A. Patterson, Durango, CO (US); Alison J. Lyons, Morristown, NJ (US); Christophe Bucher, Hillsborough, NJ (US); Daigo Ishiyama, Summit, NJ (US); Jean-Jacques L'Henaff, New Canaan, CT (US)

(73) Assignee: AS AMERICA, INC., Piscataway, NJ (US)

( * ) Notice: Subject to any disclaimer, the term of this patent is extended or adjusted under 35 U.S.C. 154(b) by 0 days.

(21) Appl. No.: 15/652,795

(22) Filed: Jul. 18, 2017

(65) Prior Publication Data

US 2018/0020880 A1 Jan. 25, 2018

Related U.S. Application Data

(60) Provisional application No. 62/364,792, filed on Jul. 20, 2016.

(51) Int. Cl.
*A47K 3/28* (2006.01)
*A47K 3/00* (2006.01)

(52) U.S. Cl.
CPC ..... *A47K 3/281* (2013.01); *A47K 3/001* (2013.01)

(58) Field of Classification Search
CPC ..... A47K 3/281
USPC ..... 211/126.51; 108/151
See application file for complete search history.

(56) References Cited

U.S. PATENT DOCUMENTS

| | | | | |
|---|---|---|---|---|
| 6,017,009 A * | 1/2000 | Swartz | A47B 57/10 108/147.13 |
| 2006/0191066 A1* | 8/2006 | Johnson | A47K 3/281 4/557 |
| 2016/0166119 A1* | 6/2016 | McDonald | A47K 3/281 4/614 |

* cited by examiner

*Primary Examiner* — Lauren A Crane
(74) *Attorney, Agent, or Firm* — Morgan, Lewis & Bockius LLP

(57) ABSTRACT

A bath or shower storage system which offers customizable storage solutions for a bath or shower. The bath or shower storage system includes a bath or shower wall having one or more integrated rails formed on the bath or shower wall, and one or more locking storage accessories which can be attached to the integrated rails. The locking storage accessories include hinge clamp that clamps on the integrated rail when the locking storage accessories are placed in a locked position, and a storage portion to store bath products. The bath or shower storage system may include a variety of storage solutions such as shallow trays, shelves, washcloth holders, and hooks.

19 Claims, 8 Drawing Sheets

ACCESSORY RAIL SYSTEM FOR BATH OR SHOWER WALLS

CROSS-REFERENCE TO RELATED APPLICATIONS

This application claims the benefit of U.S. Provisional Patent Application No. 62/364,792, filed Jul. 20, 2016, which is incorporated herein by reference in its entirety.

TECHNICAL FIELD

The present invention relates generally to bath or shower walls that include customizable storage shelves and accessories that may be integrated with the bath or shower wall.

BACKGROUND

The majority of bath or shower walls include integrated formed shelves for storage of bottles, washcloths, bathing and shaving accessories, etc. These shelves are located in fixed locations in the bath or shower wall. One drawback of this design is that users are not able to customize the number, location, or type of shelves within the bath or shower for their particular needs. For instance, large households where a number of people must share a bath or shower may require more shelving to accommodate each person's bath products. Users who are particularly tall or short, the elderly, or individuals with disabilities may desire shelving at a particular height. Users who utilize products in their bath or shower like washcloths, loofahs, toothbrushes, or shaving products may desire shelving that is particularly customized to the shapes of these products.

An alternative approach to these traditional integrated shelves is after-market shelving that may be attached to the bath or shower wall surface via a suction cup or tension rod, or alternatively hung from a shower head, shower door handle, or shower rod. These after-market shelves also face drawbacks. Suction cups are often not sturdy enough to support heavier bottles or products, and may slide along a bath or shower wall in wet and soapy conditions. Both suction cup and shower rod attachments also may create areas within the bath or shower that are difficult to clean and can become grimy. Hanging shelves also do not provide a stable storage surface for heavy products, and may become imbalanced when products of varied loads are stored on the same shelf These after-market shelves also are generally not formed of the same material, color, or pattern of the bath or shower wall, and therefore are not aesthetically pleasing when placed within the bath or shower.

There is therefore a need in the art for an effective bath or shower wall storage shelf that provides the advantages of integrated shelving and the customization advantages of after-market products, to provide better modes of bath and shower storage and allow the user to decide how many storage accessories he/she needs and the optimal positions for the storage.

BRIEF SUMMARY OF THE INVENTION

A system is disclosed for bath or shower storage that comprises a wall located on one or more sides of the bath or shower, the wall further comprising one or more rails protruding from a surface of the wall that faces the bath or shower, wherein the one or more rails are integrated with the surface of the wall; one or more locking accessories comprising a storage member and a clamp member comprising a gripping portion, wherein the storage member is attached to the clamp member via a hinge component, and wherein the one or more locking accessories may be placed in a locked position and a unlocked position, wherein the storage member contacts the gripping portion so that the gripping portion grips the one or more rails and holds the locking accessory in place when the locking accessory is placed in a locked position.

In one aspect, the locking accessory is tilted so that the locking accessory does not contact the gripping portion when the locking accessory is placed in an unlocked position. In another aspect, the locking accessory slides freely along the rail when the locking accessory is placed in an unlocked position. In another aspect, the hinge component comprises at least one pivot pin, wherein the hinge component is integrated with the clamp member and the locking accessory pivots around the pivot pin. In another aspect, the gripping portion comprises at least one protrusion on an exterior surface of the gripping portion, wherein the locking accessory contacts the protrusions when the locking accessory is in a locked position. In another aspect, the gripping portion comprises at least one gripping pad on an interior surface of the gripping portion. In another aspect, the clamp member comprises two slots, which form an upper boundary of the gripping portion.

In another aspect, the rail comprises one or more grooves on an exterior surface of the rail, wherein the gripping portion contacts the groove. In another aspect, the rail comprises an insert, wherein the surface of the wall that faces the bath or shower is formed around the insert. In another aspect, the wall comprises at least one slot, wherein the rail is inserted into the slot.

In another aspect, the locking accessory includes a storage portion that comprises grooves on a first surface of the locking accessory. In another aspect, the locking accessory includes a storage portion that comprises a vertical barrier surrounding one or more free edges of the storage member to form a tray. In another aspect, the locking accessory includes a storage portion that comprises a shelf. In another aspect, the locking accessory includes a storage portion that comprises at least one of a rod and a hook.

A locking accessory is disclosed for bath or shower storage, which comprises a storage member and a clamp member comprising a gripping portion, wherein the storage member is attached to the clamp member via a hinge component, wherein the one or more locking accessories may be placed in a locked position and an unlocked position, further wherein the storage member contacts the gripping portion so that the gripping portion grips the one or more rails and holds the locking accessory in place when the locking accessory is placed in a locked position, and the locking accessory is tilted so that the locking accessory does not contact the gripping portion when the locking accessory is placed in an unlocked position; the gripping portion further comprising at least one protrusion on an exterior surface of the gripping portion, wherein the locking accessory contacts the protrusions when the locking accessory is in a locked position; and the hinge component comprises at least one pivot pin, wherein the hinge component is integrated with the clamp member and the locking accessory pivots around the pivot pin. In another aspect, the shelf comprises a tray, a rod, or a hook. In another aspect, the gripping portion comprises at least one gripping pad on an interior surface of the gripping portion.

A bath or shower wall is disclosed wherein the wall is integrated with the bath or shower, which comprises an exterior surface that faces the bath or shower comprising one or more rails protruding from the exterior surface of the wall, wherein the one or more rails are integrated with the exterior surface of the wall. In another aspect, the bath or shower wall comprises an insert, wherein the exterior surface of the wall is formed around the insert to form the one or more rails.

In another aspect of the invention, a method of using the system is disclosed, comprising selecting a placement of the locking accessory in the unlocked position on the rail so that the clamp member contacts the rail and the storage member protrudes outwardly from the wall; and attaching the locking accessory to the wall by placing the locking accessory in the locked position at the selected placement.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The foregoing and other objects, features and advantages of the present invention, as well as the invention itself, will be more fully understood from the following description of preferred embodiments, when read together with the accompanying drawings, in which.

DETAILED DESCRIPTION OF THE INVENTION

A bath or shower wall system may be provided that allows for user-determined positioning of locking shower accessories along an integrated rail, rather than predetermined accessory locations in bath or shower wall surrounds. The users can determine the best locations for the accessories to afford a more ergonomic bathing or showering experience depending upon, for example, the individual height and reach of the user. The system has a variety of storage solutions including shelves, shallow trays, hooks and washcloth holders, for example.

Figure 1:
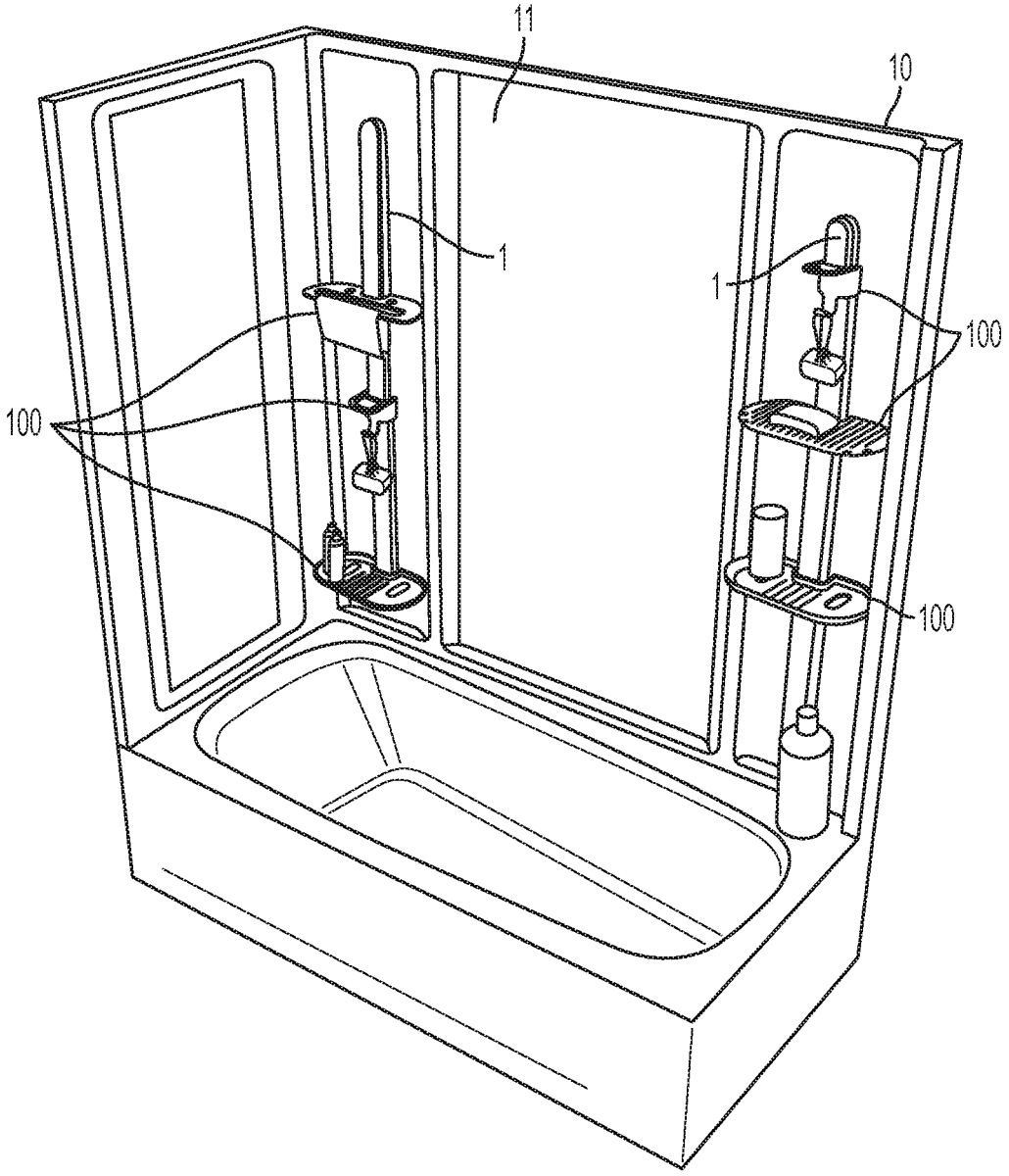
FIG. 1 shows a perspective view of a bath or shower wall having an embodiment of the integrated accessory rail shelving installed.

With reference to FIG. 1, a bath or shower wall storage system according to some embodiments of the present invention includes one or more locking storage accessories 100 that can be placed in a customized location along a rail 1 located on a bath or shower wall 10. In the illustrated embodiments, the wall 10 may include an integrated rail 1 that is formed as a protrusion from the surface of the wall 10.

A typical bath or shower includes at least one wall surface that may include shelving for bath product storage. As shown in FIG. 1, a bath or shower wall 10 includes a front surface 11 which faces into the bath or shower enclosure. The bath or shower wall 10 may be made of thermoformed acrylic or HIPS (High Impact Polystyrene), plastic, composite material, ceramic, or tile. In an embodiment, the bath or shower wall 10 may include one or more integrated rails 1. One or more locking storage accessories 100 may be placed at customized locations on the rails 1, to hold various items like bottles, soap bars, loofahs, washcloths, etc. Locking components within the locking storage accessory 100 allows for user-determined positioning and repositioning of the storage accessories by sliding the accessories 100 up and down the rail 1 that is integrated with the bath or shower wall 10, as discussed in more detail below.

Figure 2:
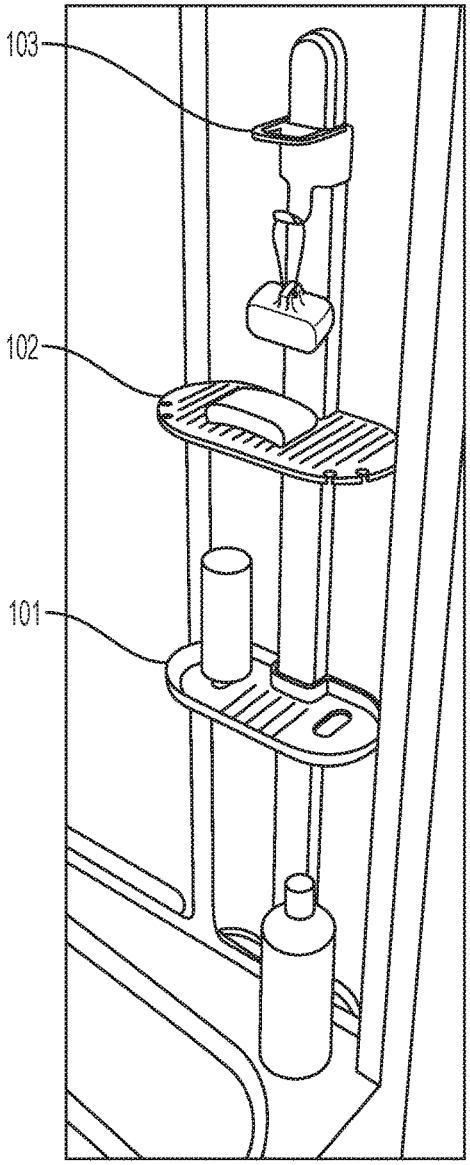
FIG. 2 shows a closer view of an embodiment of the integrated accessory rail shelving.

FIG. 2 shows a closer view of one of the rails 1 on the bath or shower wall 10. The rail 1 may be formed in the wall 10 so that it is vertical, and perpendicular to the floor of the bath or shower. It is understood by those in the art that the rail 1 may be formed in the wall 10 so that is horizontal, and parallel to the floor of the bath or shower, or alternatively at an angle.

Figure 3:
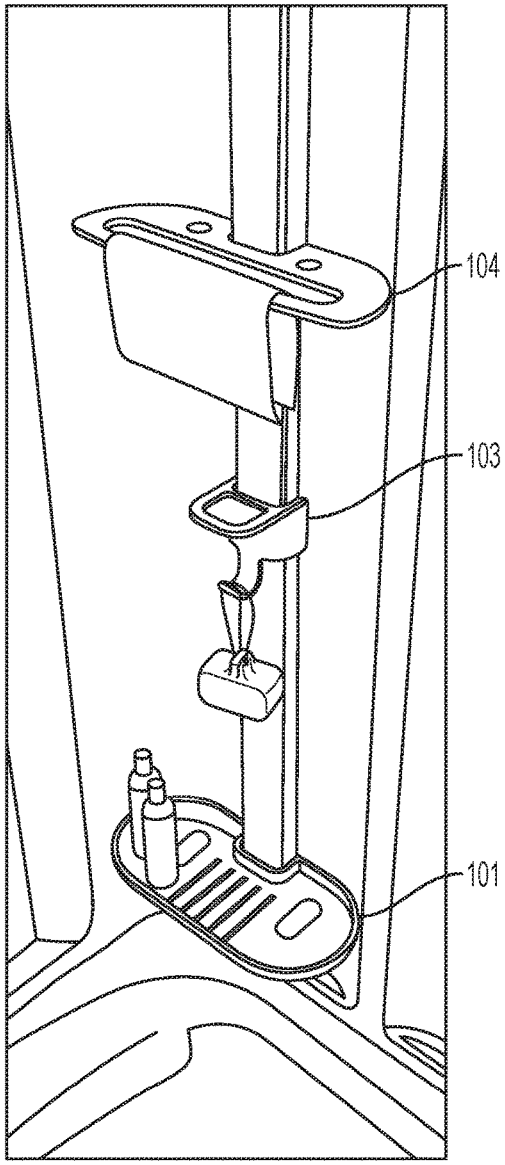
FIG. 3 shows a closer view of another embodiment of the integrated accessory rail shelving.

In an embodiment, the one or more locking storage accessories 100 may include, for example, a shallow tray 101, a soap shelf with grooves 102, and/or a hook 103. As shown in FIG. 2, each locking storage accessory 100 is clamped onto the protruding rail 1, so that it is locked onto the rail to support various bath products. FIG. 3 shows a closer view of another embodiment of the rail 1, which includes a shallow tray 101, a hook 103, and a rod 104 for locking storage accessories 100. As with the locking storage accessories 100 in FIG. 2, each locking storage accessory 100 of FIG. 3 is clamped onto the protruding rail 1, so that it is locked onto the rail to support various bath products. In this manner, the desired locking storage accessory 100 may be placed along the rail 1 at the desired height and in the desired order. The locking storage accessory 100 may be positioned and repositioned as desired in a variety of configurations and at the selection and discretion of the user. One aspect of the invention allows for selection of the placement and/or positioning of the locking storage accessory 100 at any height along rail 1 that is integrated with the bath or shower wall 10.

Figure 4:
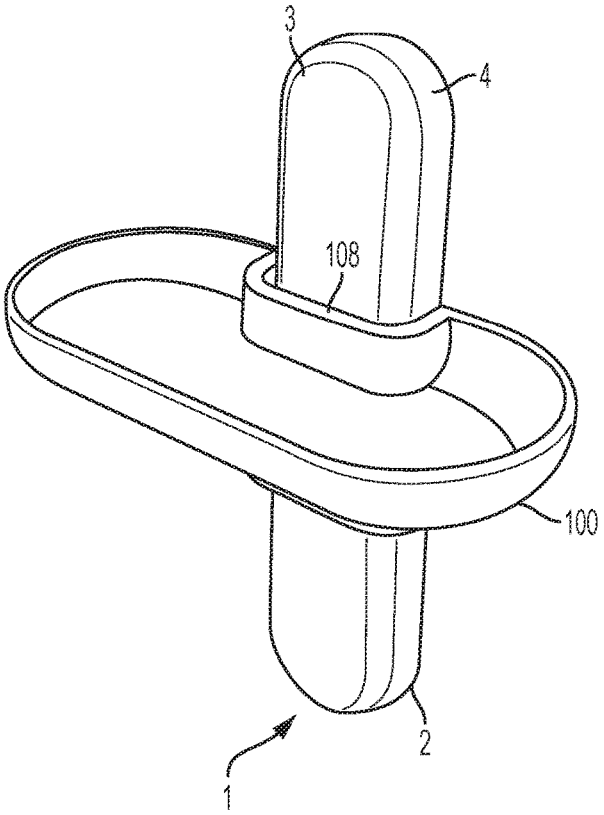
FIG. 4 shows a front perspective view of a single installed storage accessory in an embodiment of the integrated accessory rail shelving.

In an embodiment, the rail 1 is integrated with the wall 10. As shown in FIG. 4, in an embodiment, the rail 1 includes a protruding portion 2 that is formed as part of the wall 10. In an embodiment, the rail 1 may be formed simply as a single protruding piece that is formed as part of the wall 10 and includes a front facing portion 3. In some embodiments, rail 1 is permanently attached to wall 10. In some embodiments, rail 1 is integrally formed with wall 10. Preferably, the rail 1 is therefore formed of the same material as the wall 10. In an embodiment, the rail 1 can also include a capping portion that covers the protruding portion to form an outward-facing portion of the rail 1. In some embodiments, rail 1 is formed separately from wall 10 and attached to wall 10 by a user. In some embodiments, rail 1 is removably secured to wall 10 such that rail 1 may be separated from wall 10. In an embodiment, the wall 10 may include slots which allow for the rail 1 to be inserted into the wall 10 through the slots. It is understood by those in the art that the size, shape, and placement of the rail 1 may vary depending on the size, shape, and configuration of the bath or shower, so as to optimize the placement of locking storage accessories 100 in desired locations within the bath or shower.

In an embodiment, the rail 1 includes a groove 4 located on the sides of the rail 1. The locking storage accessory 100 also includes a recessed area 108 on one edge of the storage accessory which fits around the rail 1. In this manner, the locking storage accessory 100 may attach seamlessly to the rail 1.

Figure 5:
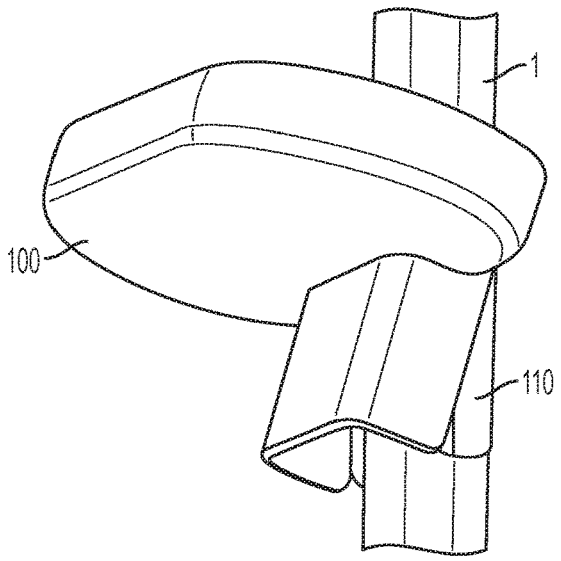
FIG. 5 shows a side perspective view of a single installed storage accessory in a disengaged position in an embodiment of the integrated accessory rail shelving.
Figure 6:
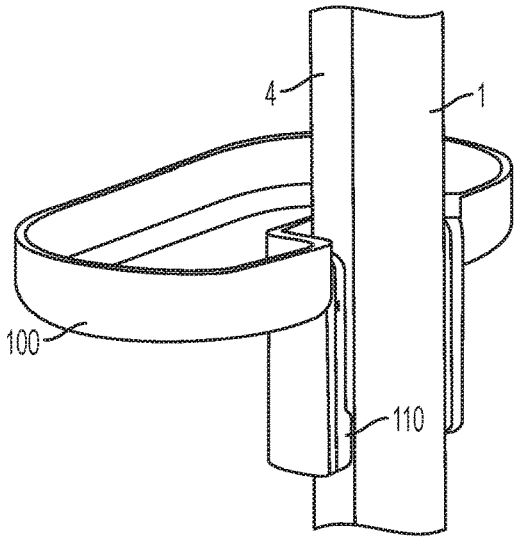
FIG. 6 shows a rear perspective view of a single installed storage accessory in an embodiment of the integrated accessory rail shelving.

In some embodiments, each locking storage accessory 100 includes a locking mechanism for fixing the position of the locking storage accessory 100 on rail 1. In some embodiments, the locking mechanism can be transitioned between an unlocked position which allows the locking storage accessory 100 to slide along rail 1 and a locked position which prevents the locking storage accessory 100 from sliding relative to rail 1. FIGS. 5 and 6 show a locking mechanism for the locking storage accessories 100 in accordance with certain embodiments of the present invention. FIG. 5 shows the locking storage accessory 100 in an unlocked position, and reveals a hinge clamp 110 of the locking storage accessory 100. In this manner, the locking storage accessory 100 includes a storage accessory portion (e.g. a shallow tray 101, soap dish 102, hook 103, washcloth rod 104, etc.) which is attached to a hinge clamp 110, so that the locking storage accessory 100 and the hinge clamp 110 fit together and the hinge clamp 110 nests within the locking storage accessory 100. In some embodiments, hinge clamp 110 nests within recessed area 108. The locking storage accessory 100 is preferably made of injection molded plastic.

When the locking storage accessory 100 is placed in the unlocked position (with the locking storage accessory 100 angled upwards), as shown in FIG. 5, the locking storage accessory 100 slides along the rail 1 freely. This allows for a user to slide the locking storage accessory 100 along the rail to the desired position along the rail 1.

Once a user determines the desired position along rail 1, he/she pivots the locking storage accessory 100 down to compress the hinge clamp 110 against the rail 1, thereby locking the position of the locking storage accessory 100 at a fixed location on the rail 1. In some embodiments, hinge clamp 110 abuts against rail 1 and engages with groove 4 located on the sides of rail 1 when the locking storage accessory 100 is in a locked position. Likewise, to change the position of the locking storage accessory 100, the user can pivot the locking storage accessory 100 upwards to unlock the hinge clamp 110 and slide the storage accessory 100 along the rail 1 to a new location and lock it in place. In this manner, the locking storage accessory 100 can also be removed from the wall 10 for easy cleaning.

FIG. 6 shows the locking storage accessory 100 in a locked position, in an embodiment. In the locked position, the locking storage accessory 100 wraps around the rail 1, and clamps onto the groove 4 of the rail 1. In some such embodiments, locking storage accessory 100 is locked in place with respect to rail 1 and is prevented from sliding along rail 1. In this manner, the locking storage accessory 100 sturdily grips to the rail 1, and provides storage support for bath products placed on the locking storage accessory 100.

Figure 7:
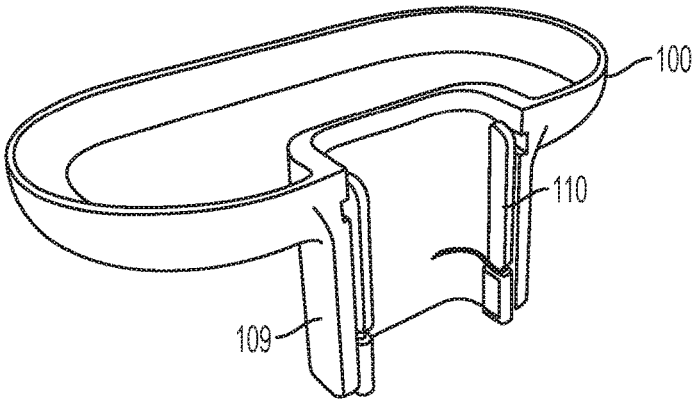
FIG. 7 shows a rear perspective view of a single storage accessory prior to installation in an embodiment of the integrated accessory rail shelving.

FIG. 7 displays the locking storage accessory 100 and hinge clamp 110 in more detail. In a locked position, the hinge clamp 110 nests within a clamping portion 109 of the locking storage accessory 100. In this manner, when the locking storage accessory 100 is tilted upwards to the unlocked position, as seen in FIG. 5, the clamping portion 109 pivots away from the hinge clamp 110 and releases the hinge clamp 110.

Figure 8:
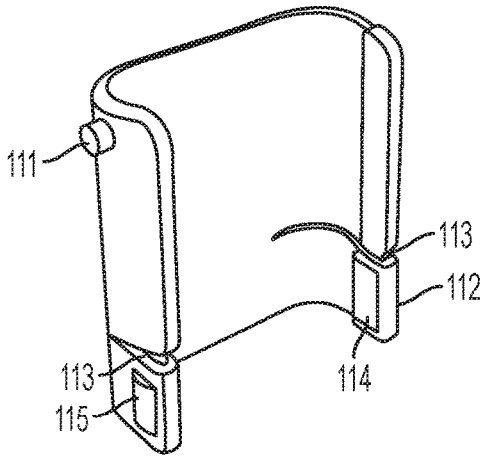
FIG. 8 shows a closer view of an engaging component in an embodiment of the integrated accessory rail shelving.

In some embodiments, locking storage accessory 100 may be coupled to hinge clamp 110 by a hinge component. In some embodiments, the hinge component is configured to allow locking storage accessory 100 to pivot relative to hinge clamp 110, for example, about the one or more pivot pins. As shown in FIG. 8, in an embodiment, the hinge clamp 110 includes two pivot pins 111 on either side of the hinge clamp 110. The pivot pins 111 are located within corresponding holes in the locking storage accessory 100, so that the locking storage accessory 100 may rotate around the pivot pin 111. The hinge clamp 110 includes a gripping portion 112 at the bottom portion of the hinge clamp 110. In an embodiment, the gripping portion 112 is formed by two slots 113 in the hinge clamp 110, which allow for the gripping portion 112 to bend in an inwards direction, separately from the body of the hinge clamp 110. The slots 113 may define an upper boundary of the gripping portion 112. In some embodiments, the gripping portion 112 also includes protrusions 115 on the exterior surface of the gripping portion 112, which contact the clamping portion 109 of the locking storage accessory 100. In an embodiment, the gripping portion 112 also includes gripping pads 114 on the interior surface of the gripping portion 112. These gripping pads 114 increase the friction between the gripping portion 112 and the rail 1, to increase the sturdiness of the locking storage accessory 100 when in the locked position.

In this manner, when the locking storage accessory 100 is placed in the locked position, the clamping portion 109 of the locking storage accessory 100 is pivoted downwards around the hinge clamp 110, and clamps down on the hinge clamp 110 by contacting the protrusions 115 on the gripping portion 112, and forcing the gripping portion 112 inwards. The gripping pads 114 then contact the rail 1, and the hinge clamp 110 clamps down on the rail 1, thus locking the locking storage accessory 100 in place. In some embodiments, pivoting the locking storage accessory 100 upwards relative to hinge clamp 110 separates clamping portion 109 from gripping portion 112, which in turn allows gripping portion 112 to flex outward and unlock from rail 1.

Figure 9A:
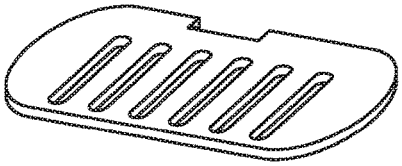
FIG. 9A-9D show various embodiments of locking shelving and storage components which may be used in an embodiment of the integrated accessory rail shelving.
Figure 9B:
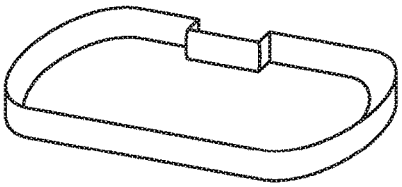
Figure 9C:
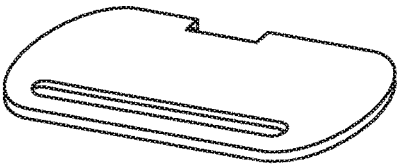
Figure 9D:
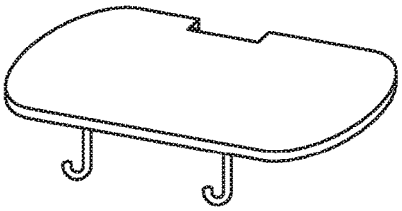

In an embodiment, a plurality of locking storage accessories 100 may be attached to a single bath or shower wall 10. As seen in FIGS. 2 and 3, the locking storage accessories 100 may have a number of different sizes, shapes, and configurations to store various bath products. For instance, FIG. 9A shows an embodiment of the locking storage accessory 100, soap dish 102 that includes grooves on the shelf in order to store a bar of soap, a sponge, or other products that require air-drying on all surfaces. FIG. 9B shows an embodiment of the locking storage accessory 100, shallow tray 101 that includes a shallow tray to store items that may roll or slip off a shelf. The tray 101 may include, for example, a vertical barrier surrounding one or more free edges of the tray 101 that is configured to help retain items on the tray 101. FIG. 9C shows an embodiment of the locking storage accessory 100, washcloth rod 104 that includes a rod to hang a washcloth. FIG. 9D shows an embodiment of the locking storage accessory 100, hook 103 that includes one or more hooks to hang smaller items like razors, toothbrushes, and loofahs. It is understood by those in the art that the size and shape of the locking storage accessory 100 may be modified to accommodate specific types and sizes of bath products.

In an embodiment, a user who purchases the bath or shower wall system may be provided with a kit of locking storage accessories 100 of varying sizes and designs in order to customize the user's bath or shower storage. In an embodiment, additional accessories may be offered to extend the system and accommodate larger families or those with greater or particular storage needs.

Figure 10:
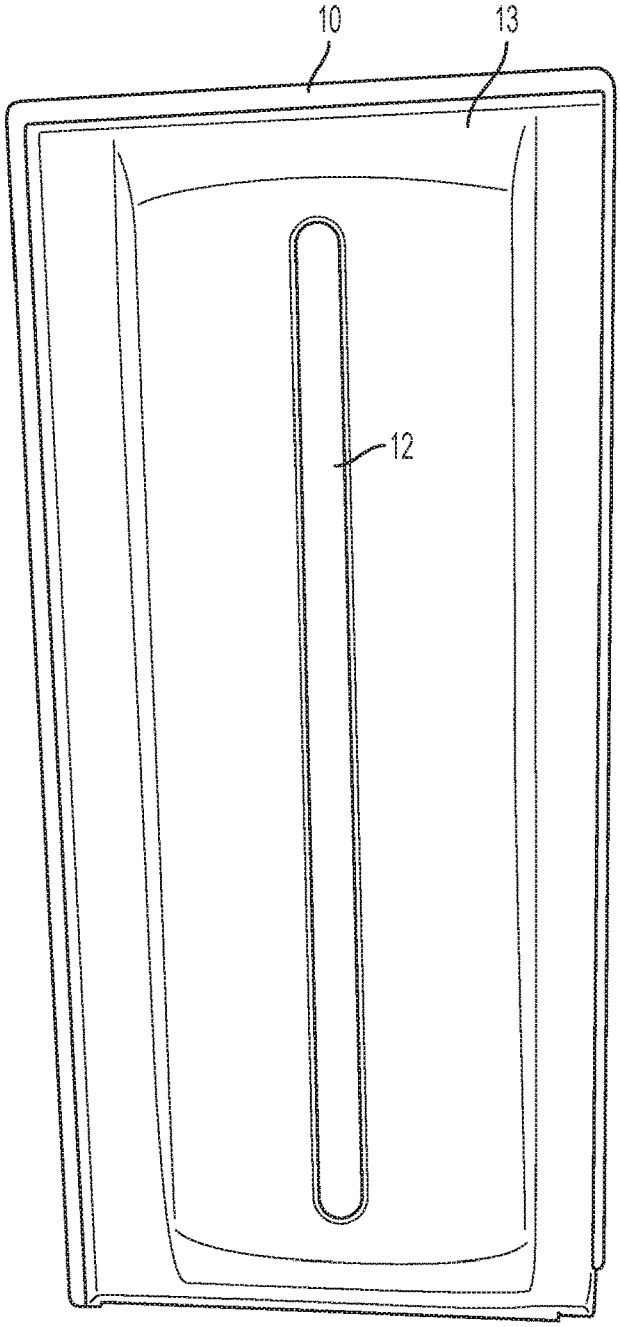
FIG. 10 shows a rear view of the bath or shower wall in an embodiment of the integrated accessory rail shelving.
Figure 11:
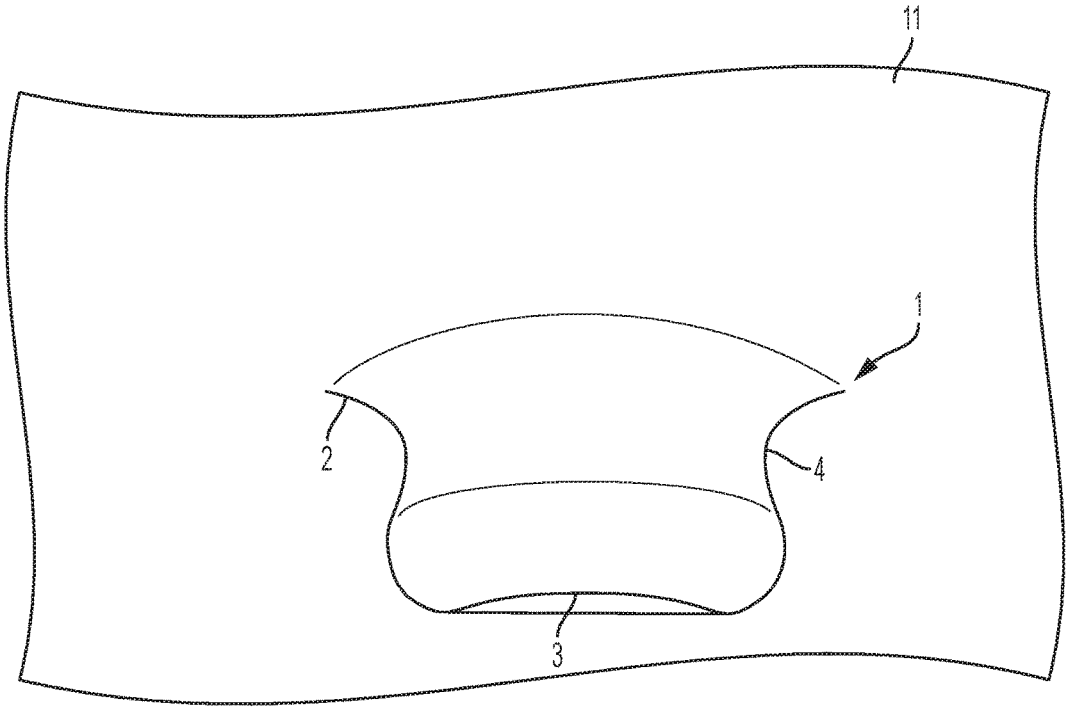
FIG. 11 shows a top view of the rail in an embodiment of the integrated accessory rail shelving.

The formation of the rail, as integrated with the wall in an embodiment, is shown in more detail in FIGS. 10 and 11. The rail 1 may be formed by forming the wall 10 over one or more inserts 12. Thus, the wall 10 is formed such that the front surface 11 of the wall 10 is seamlessly integrated with the rail 1. After the front surface 11 is formed over the insert 12, the insert 12 is viewable on the back surface 13 of the wall 10, as shown in FIG. 10. It is understood by those in the art that the shape and size of the rail 1 is defined by the shape and size of the insert 12. The insert may be formed of any sturdy material, including wood, dense foam with a high heat resistance, or plastic with a high heat resistance.

As shown in FIG. 11, the rail 1 protrudes from the front surface 11 of the wall 10 in a protruding portion 2, but is integrated with the wall 10, such that there are no seam lines. Further, the rail is formed such that the rail 1 includes grooves 4 on either side of the rail 1. In an embodiment, the grooves 4 are formed such that the cross-section of the rail 1 includes an S-shaped curve on either side of the rail 1. This allows for the insert 12 to remain stationary within the wall 10, as the wider portion of the insert 12 cannot be removed through the grooves 4.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

The invention claimed is:

1. A system for bath or shower storage, comprising:

a wall located on one or more sides of the bath or shower, the wall further comprising one or more rails protruding from a surface of the wall that faces the bath or shower, wherein the one or more rails are integrated with the surface of the wall;

one or more locking accessories comprising a storage member and a clamp member comprising a gripping portion, wherein the storage member is attached to the clamp member via a hinge component, and wherein the one or more locking accessories may be placed in a locked position and a unlocked position, wherein the storage member contacts the gripping portion so that the gripping portion grips the one or more rails and holds the locking accessory in place when the locking accessory is placed in the locked position, the gripping portion comprising at least one protrusion on an exterior surface of the gripping portion, wherein the one or more locking accessories contact the at least one protrusion when the one or more locking accessories are in the locked position.

2. The system of claim 1, wherein the locking accessory is tilted so that the locking accessory does not contact the gripping portion when the locking accessory is placed in an unlocked position.

3. The system of claim 2, wherein the locking accessory slides freely along the rail when the locking accessory is placed in an unlocked position.

4. The system of claim 1, the hinge component further comprising at least one pivot pin, wherein the hinge component is integrated with the clamp member and the locking accessory pivots around the pivot pin.

5. The system of claim 1, the gripping portion further comprising at least one gripping pad on an interior surface of the gripping portion.

6. The system of claim 1, the clamp member further comprising two slots, which form an upper boundary of the gripping portion.

7. The system of claim 1, the rail further comprising one or more grooves on an exterior surface of the rail, wherein the gripping portion contacts the groove.

8. The system of claim 7, the rail further comprising an insert, wherein the surface of the wall that faces the bath or shower is formed around the insert.

9. The system of claim 7, wherein the wall comprises at least one slot, wherein the rail is inserted into the slot.

10. The system of claim 1, wherein the storage member includes a storage portion that comprises grooves on a first surface of the locking accessory.

11. The system of claim 5, wherein the storage member includes a storage portion that comprises a vertical barrier surrounding one or more free edges of the storage member to form a tray.

12. The system of claim 1, wherein the storage member includes a storage portion that comprises a shelf.

13. The system of claim 1, wherein the storage member includes a storage portion that comprises at least one of a rod and a hook.

14. A locking accessory for bath or shower storage, comprising:

a storage member and a clamp member comprising a gripping portion, wherein the storage member is attached to the clamp member via a hinge component, wherein the locking accessory may be placed in a locked position and an unlocked position, wherein the storage member contacts the gripping portion when the locking accessory is placed in a locked position, and the storage member does not contact the gripping portion when the locking accessory is placed in an unlocked position, wherein the gripping portion comprises at least one protrusion on an exterior surface of the gripping portion, wherein the storage member contacts the at least one protrusion when the locking accessory is in the locked position, wherein the hinge component comprises at least one pivot pin, wherein the hinge component is integrated with the clamp member and the storage member pivots around the pivot pin.

15. The locking accessory of claim 14, wherein the storage member comprises a tray, a rod, or a hook.

16. The locking accessory of claim 14, the gripping portion further comprising at least one gripping pad on an interior surface of the gripping portion.

17. A bath or shower wall, wherein the wall is integrated with the bath or shower, comprising:

an exterior surface that faces the bath or shower comprising one or more rails protruding from the exterior surface of the wall;

wherein the one or more rails are integrated with the exterior surface of the wall, and wherein there are no seams between the one or more rails and the exterior surface of the wall; and an insert, wherein the exterior surface of the wall is formed around the insert to form the one or more rails.

18. A method of using the system of claim 1, comprising:

selecting a placement of the locking accessory in the unlocked position on the rail so that the clamp member contacts the rail and the storage member protrudes outwardly from the wall; and attaching the locking accessory to the wall by placing the locking accessory in the locked position at the selected placement.

19. A system for bath or shower storage, comprising:

a wall located on one or more sides of the bath or shower, the wall further comprising one or more rails protruding from a surface of the wall that faces the bath or shower, wherein the one or more rails are integrated with the surface of the wall;

one or more locking accessories comprising a storage member and a clamp member comprising a gripping portion, the gripping portion comprising at least one gripping pad on an interior surface of the gripping portion, wherein the storage member is attached to the clamp member via a hinge component, and wherein the one or more locking accessories may be placed in a locked position and a unlocked position, wherein the storage member contacts the gripping portion so that the gripping portion grips the one or more rails and holds the locking accessory in place when the locking accessory is placed in the locked position.

* * * * *